US005105947A

United States Patent [19]

Wise

[11] Patent Number: 5,105,947

[45] Date of Patent: Apr. 21, 1992

[54] CONTAINER HAVING A REPLACEABLE PALLET BASE

[75] Inventor: Thomas W. Wise, Oreland, Pa.

[73] Assignee: Plastech International, Inc., Warminster, Pa.

[21] Appl. No.: 170,143

[22] Filed: Mar. 18, 1988

Related U.S. Application Data

[63] Continuation of Ser. No. 784,335, Oct. 4, 1985, abandoned.

[51] Int. Cl.[5] ..... B65D 90/16

[52] U.S. Cl. ..... 206/519; 206/386; 206/599; 210/625

[58] Field of Search ..... 206/509, 386, 511, 512, 206/597, 518, 598, 519, 599, 514, 600; 108/55.1, 55.3, 55.5, 56.1, 56.3, 57.1, 52.1, 51.1; 220/69, 72, 1.5

[56] References Cited

U.S. PATENT DOCUMENTS

| | | | |
|---|---|---|---|
| 2,872,079 | 2/1959 | Moore | 220/69 |
| 3,307,739 | 3/1967 | Cloyd | 220/72 |
| 3,394,832 | 7/1968 | McAllister | 220/69 |
| 3,758,534 | 1/1974 | Smith | 206/599 |
| 3,921,540 | 11/1975 | Melnick | 220/386 |
| 4,061,090 | 12/1977 | Callon | 206/599 |
| 4,280,640 | 7/1981 | Dalorsio | 220/1.5 |
| 4,416,374 | 11/1983 | Smith | 206/518 |
| 4,503,973 | 3/1985 | Andersson | 206/386 |

FOREIGN PATENT DOCUMENTS

| | | | |
|---|---|---|---|
| 2210693 | 9/1973 | Fed. Rep. of Germany | 150/55 |
| 2411777 | 8/1979 | France | 206/511 |
| 222028 | 9/1924 | United Kingdom | 220/69 |
| 2115382 | 9/1983 | United Kingdom | 206/599 |
| 2118139 | 10/1983 | United Kingdom | 206/386 |

*Primary Examiner*—Stephen Marcus
*Attorney, Agent, or Firm*—John F. A. Earley, III

[57] ABSTRACT

A two-piece plastic container for handling and storing large quantities of bulk material such as food products comprises a unitary molded plastic liquid-tight single wall tank having a bottom wall and four upwardly extending side walls, and a replaceable pallet base mounted to the tank for supporting the tank and for providing spaces for entry of tines of a forklift truck or a pallet jack. The container is provided with gussets at the top of the walls of the container that support the lip, and is also provided with corner nesting stops located at each corner of the upper end of the container to facilitate nesting of containers. A lid fits over the container lip and has a skirt that is blended inwardly towards the lip so as not to catch on a lip or lid of an adjacent container. The lid also has recesses in its top surface that facilitate the stacking of containers.

21 Claims, 7 Drawing Sheets

CONTAINER HAVING A REPLACEABLE PALLET BASE

This is a continuation of co-pending application Ser. No. 784,335 filed on Oct. 4, 1985, now abandoned.

BACKGROUND OF THE INVENTION

1. Field of the Invention

This invention relates to stackable and nestable containers for bulk materials, and more specifically concerns large containers for food and chemicals, for example, for shipping processed meats or chickens from one processor to another for further processing.

2. Description of the Prior Art

In certain industries such as in food processing, agriculture, chemical, and petro-chemical industries, large containers are used to hold and ship bulk materials. The handling and lifting of these containers require the use of forklift truck and/or pallet jacks.

In recent years, containers made entirely of plastic have been used, such as those described in U.S. Pat. Nos. 4,042,111 and 4,416,374 which are incorporated herein by reference. These containers have three parallel, laterally spaced, downward extending, hollow ridges in their bottom walls that act as support members for the container and establish between adjacent pairs of ridges spaces for the entry of the tines of a forklift truck or a pallet jack.

A problem with these containers has been that their bottom walls, especially at the downwardly extending ridges, are exposed to potential damage caused by the tines of a forklift truck or pallet jack. For example, if a forklift driver is careless or sloppy when approaching a container to transport it, he may cause the tines of the forklift to strike and rupture a ridge in the bottom wall of the container, thereby necessitating replacement of the container.

SUMMARY OF THE INVENTION

It is an object of this invention to provide a plastic U.S.D.A. approved container for handling and storing large quantities of bulk material such as food products that has a separate pallet base so as to make the container a two-piece unit so that only the pallet base, rather than the entire container, has to be replaced if the pallet base is damaged by the tines of a forklift truck.

Another object of the invention is to provide a plastic container that has spaces for entry of forklift tines on each of the four sides of the container.

Another object is to provide a plastic container that can be stacked on lids when full, and nested when empty.

Still another object is to provide a plastic container having an inner flat bottom that is easily cleaned.

Another object is to provide a container with a stronger lip to prevent chipping and breakage of the tank upper edges.

Another object is to provide a two-piece container molded of plastic with gussets that reinforce the vertical peripheral lip of the tank, so that the gusset acts like a shelf bracket to support the outside portion of the lip.

Another object is to provide a tight fitting lid for the container that overlies the vertical peripheral lip so that the lid skirt does not project outwardly unduly and is blended towards the vertical lip of the container so as not to catch on the lip or lid of an adjacent container during loading of containers into a truck, for example.

Another object is to provide a plastic container having a drain fitting which enables the container to be coupled with any external plumbing that may be required for various applications.

DETAILED DESCRIPTION

Figure 1:
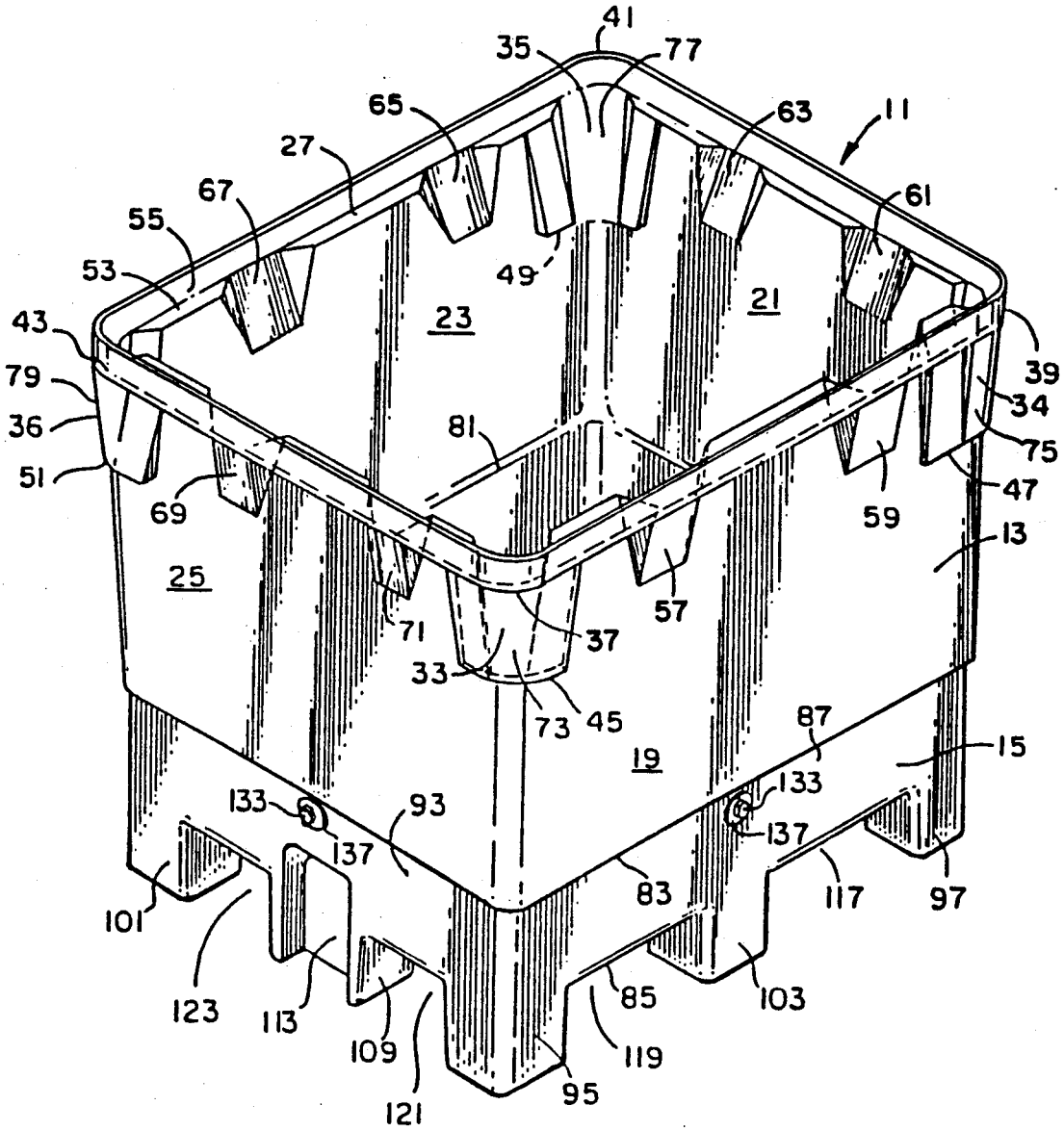
FIG. 1 is a perspective view of a container constructed in accordance with this invention.
Figure 2:
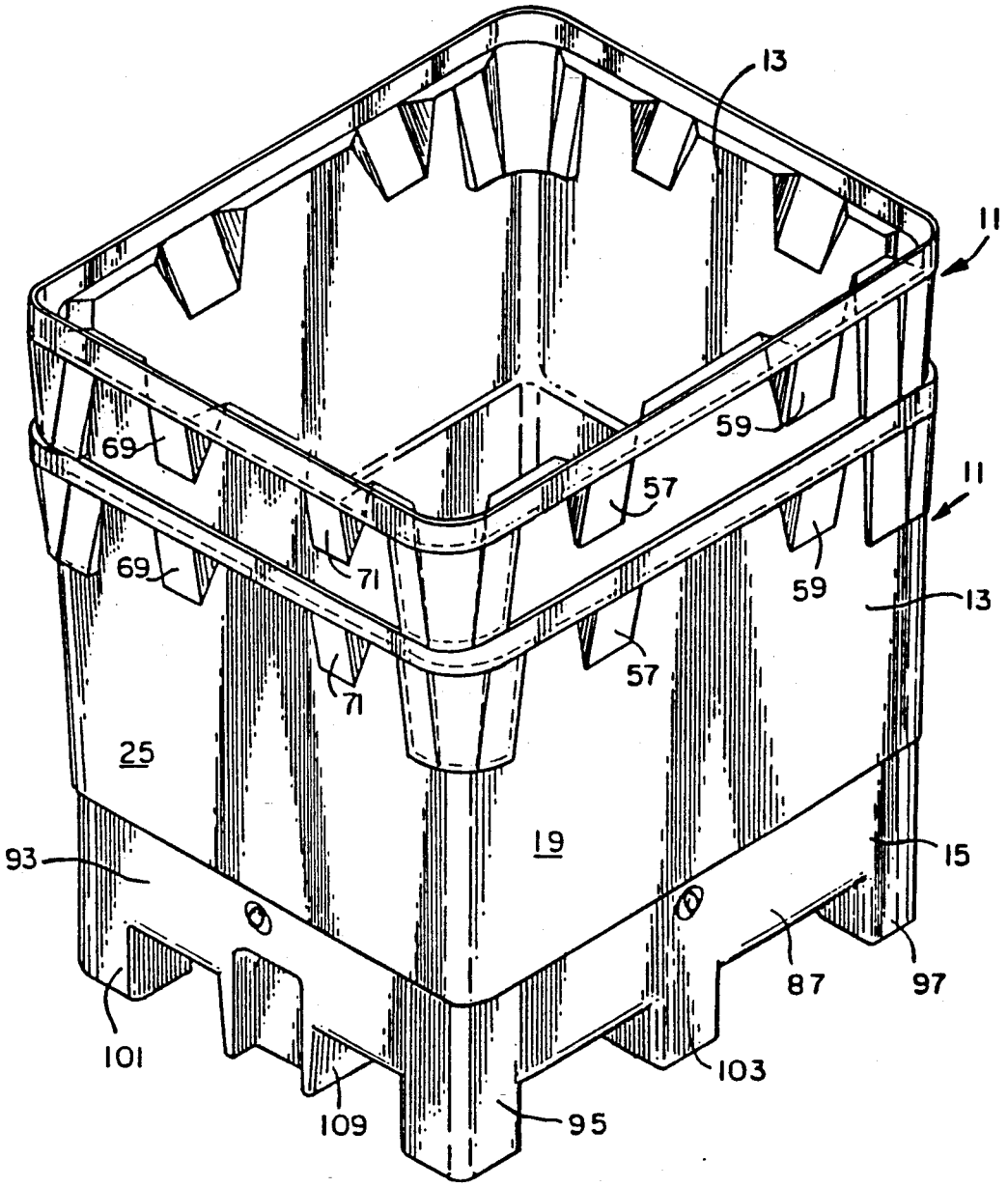
FIG. 2 is a perspective view of a container nesting inside another container.
Figure 3:
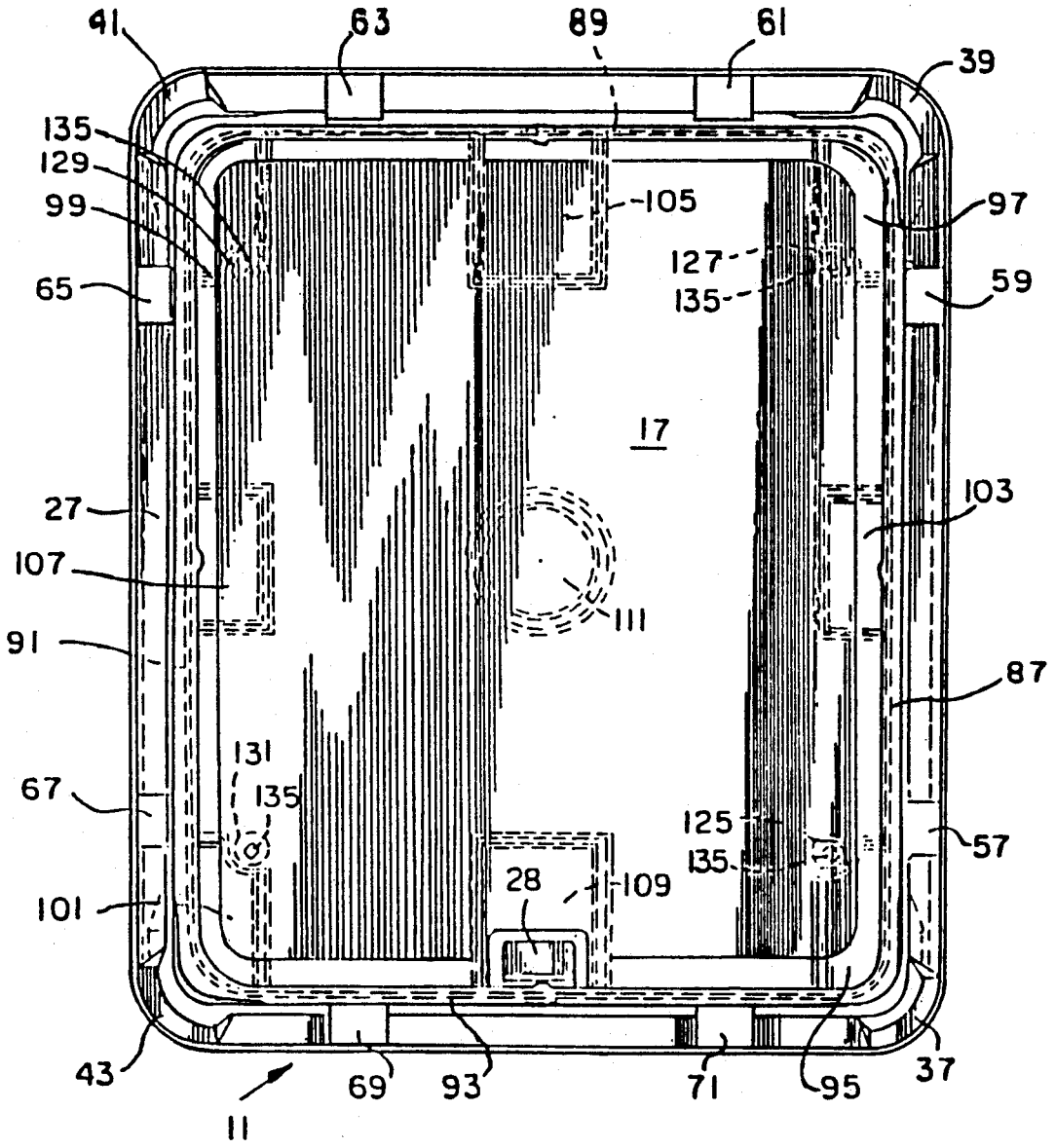
FIG. 3 is a top plan view of the container of FIG. 1.
Figure 4:
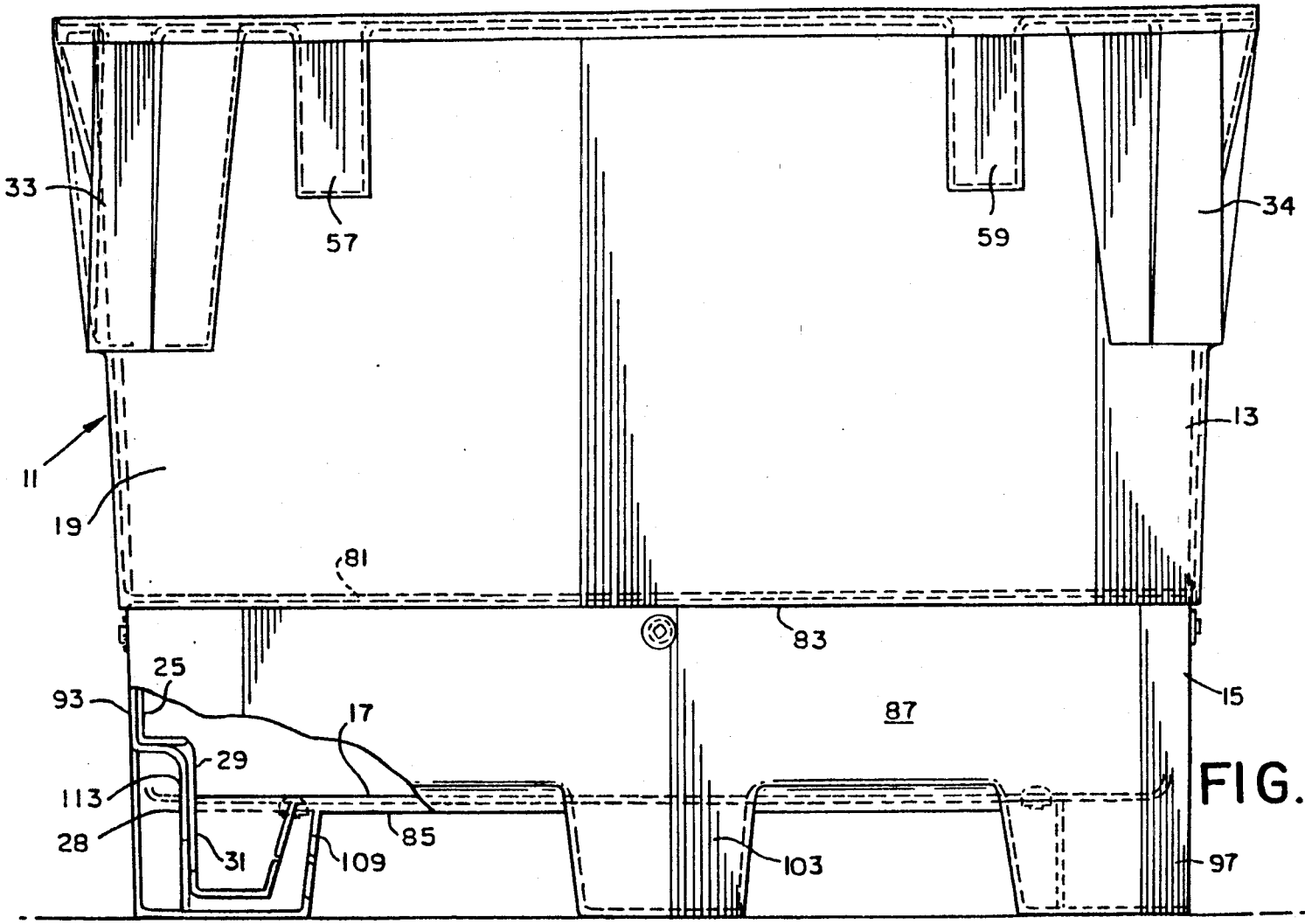
FIG. 4 is a front view in elevation of the container of FIG. 1 with parts cut away showing the sump.
Figure 5:
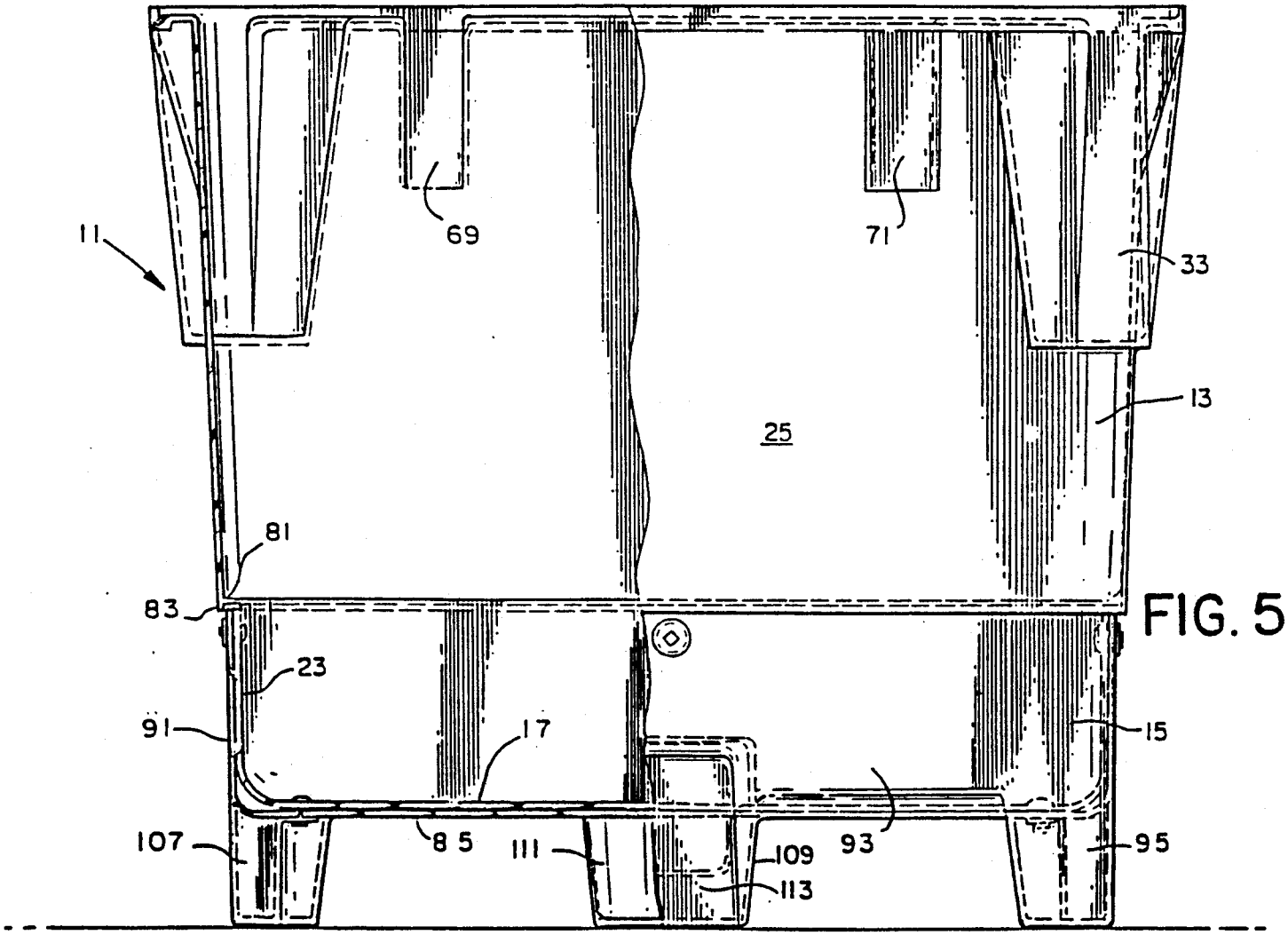
FIG. 5 is a side view in elevation of the container of FIG. 1 with parts cut away showing the connection between the tank and the pallet base of the container.

Turning now to the drawings, there is shown a plastic container 11 for handling and storing large quantities of bulk material such as food products, which comprises a tank 13 and a pallet base 15.

Tank 13 has a bottom wall 17, four upwardly extending side walls 19, 21, 23, and 25, and a lip 27 along the upper edges of the four side walls 19, 21, 23, and 25.

Tank bottom wall 17 is flat for easy contents removal and cleaning, and has a sump 28 formed in it.

The four side walls 19, 21, 23, and 25 are typically about one-third of an inch in thickness, and slope slightly outwardly from bottom to top by a distance greater than the thickness of the walls to facilitate nesting and unnesting when containers 11 are not in use. Side wall 25 is provided with a recess 29 that forms the back wall 31 of sump 28.

In order to prevent the containers 11 from wedging together when nesting one inside another, tank 13 is provided with corner nesting stops 33, 34, 35, and 36 at each corner 37, 39, 41, and 43 at the upper end of tank 139 The corner nesting stops 33–36 preferably extend downwardly 14 inches from the top of tank 13 and slope outwardly from bottom to top. The bottom edges 45, 47, 49, and 51 of the corner nesting stops 33–36 preferably extend outwardly from the four tank side walls 19, 21, 23, and 25 by typically three-quarters of an inch.

The lip 27 extends along the upper edges of tank side walls 19, 21, 23, and 25 and comprises a ledge 53 and a lip wall 55.

Molded into the tank side walls 19, 21, 23, and 25 are gussets 57, 59, 61, 63, 65, 67, 69, and 71, and corner gussets 73, 75, 77, and 79, that act as support means for the lip 27. Each gusset provides support to lip 27 by reinforcing the ledge 53 which extends around the periphery of the tank 13 and is flush with the outside periphery of the lip wall 57. Each gusset also acts as a guide for a container 11 being lowered next to an adjacent container 11 to guide or cam the container into proper position.

In addition to acting as supports for lip 27, and as guides for a container 11 being lowered next to an adjacent container 11, the corner gussets 73, 75, 77, and 79 perform a third function. The corner gussets 73, 75, 77, and 79 act as bumpers to protect the tank corners 37, 39, 41, and 43 from damage due to impacts with door jambs when being transported on a forklift truck, for example.

Figure 8:
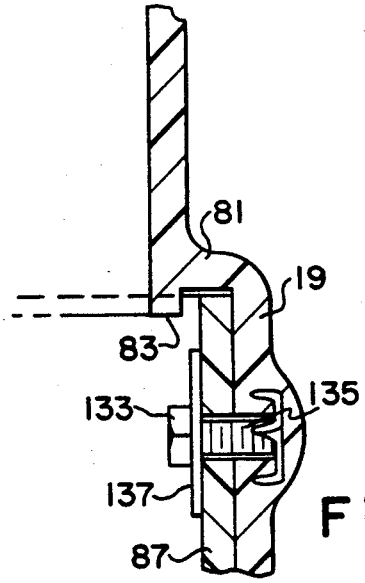
FIG. 8 is a partial view in section taken as indicated by the lines and arrows 8—8 of FIG. 6.

Referring to FIG. 8, an internal ledge 81 is molded into the four tank side walls 19, 21, 23, and 25. A downwardly extending ridge 83 is also molded into the four tank side walls 19, 21, 23, and 25 at the outer bottom portion of the internal ledge 81 and extends around the perimeter of tank 13.

Pallet base 15 is tub-like, is made of molded plastic, and has a bottom wall 85 and four upwardly extending side walls 87, 89, 91, and 93.

Pallet base bottom wall 85 has four downwardly extending hollow corner legs 95, 97, 99, and 101, four downwardly extending hollow side legs 103, 105, 107, and 109 halfway between each corner leg 95, 97, 99, and 101, and a downwardly extending hollow center leg 111 at the center of the pallet base bottom wall 85. Side leg 109 is provided with a recess 113 to facilitate adding an optional drain fitting 115 to container 11.

A space 117 is formed between adjacent pairs of legs 97, 103 and 105, 111 and 99, 107. Another space 119 is formed between adjacent pairs of legs 95, 103 and 109, 111 and 101, 107. Spaces 117 and 119 are established for entry of the tines of a forklift truck or a pallet jack.

A space 121 is also formed between adjacent legs 95, 109 and 103, 111 and 97, 105. Another space 123 is formed between adjacent pairs of legs 101, 109 and 107, 111 and 99, 105. Spaces 121 and 123 are also formed to permit entry of the tines of a forklift truck or a pallet jack.

With spaces 117 and 119 and spaces 121 and 123, the tines of a forklift have an entrance on all four sides of pallet base 15.

Pallet base bottom wall 85 is also provided with four recesses 125, 127, 129, and 131. Recess 125 is in the innermost corner of corner leg 95, recess 127 is at the innermost corner of corner leg 97, recess 129 is at the innermost corner of corner leg 99, and recess 131 is at the innermost corner of corner leg 101.

Pallet base 15 is replaceably mounted to tank 13 with a plurality of nuts 133, bolts 135, and washers 137.

As is shown in FIG. 8, tank side walls 19, 21, 23, and 25 each have a bolt 135 molded into them at the longitudinal center line of each tank side wall just below the internal ledge 81. Each bolt 135 molded into the tank side walls 19, 21, 23, and 25 extends outwardly from the tank side wall and through the corresponding pallet base side wall. A washer 137 and a nut 133 are attached to the outer end of each bolt 135 to secure the tank side walls 19, 21, 23, and 25 to the corresponding pallet base side walls 87, 89, 91, and 93.

The tank bottom wall 17 has four bolts 135, molded into it that extend downwardly through pallet base bottom wall 85 at each of the recesses 125, 127, 129, and 131 of the pallet base bottom wall 85. A washer 137 and nut 133 are attached to the end of each bolt 135 to secure the pallet base bottom wall 85 to the tank bottom wall 17.

Container 11 is provided with a cover or lid 139. Lid 139 is a unitary piece of molded plastic adapted to rest on lip 27. Lid 139 is provided with a depending skirt 141 around its edge that fits tightly over lip wall 55 to provide a secure closure, and to prevent the lid 139 from moving laterally with respect to the container 11. Skirt 141 is provided with a portion 143 that is blended inwardly towards the vertical lip wall 55 of the tank 13 so as not to catch on a lip or lid of an adjacent container 11.

Lid 139 has a top surface 145 that has nine rectangularly shaped recesses 147, 148, 149, 150, 151, 152, 153, 154, and 155 that are provided to facilitate stacking of containers. Recesses 147–155 are adapted to receive legs 95, 97, 99, 101, 103, 105, 107, 109 and 111 of a container 11 sitting on top of it to prevent lateral shifting. Top surface 145 of lid 139 has a border portion 157 that slopes downwardly towards skirt 141.

Figure 6:
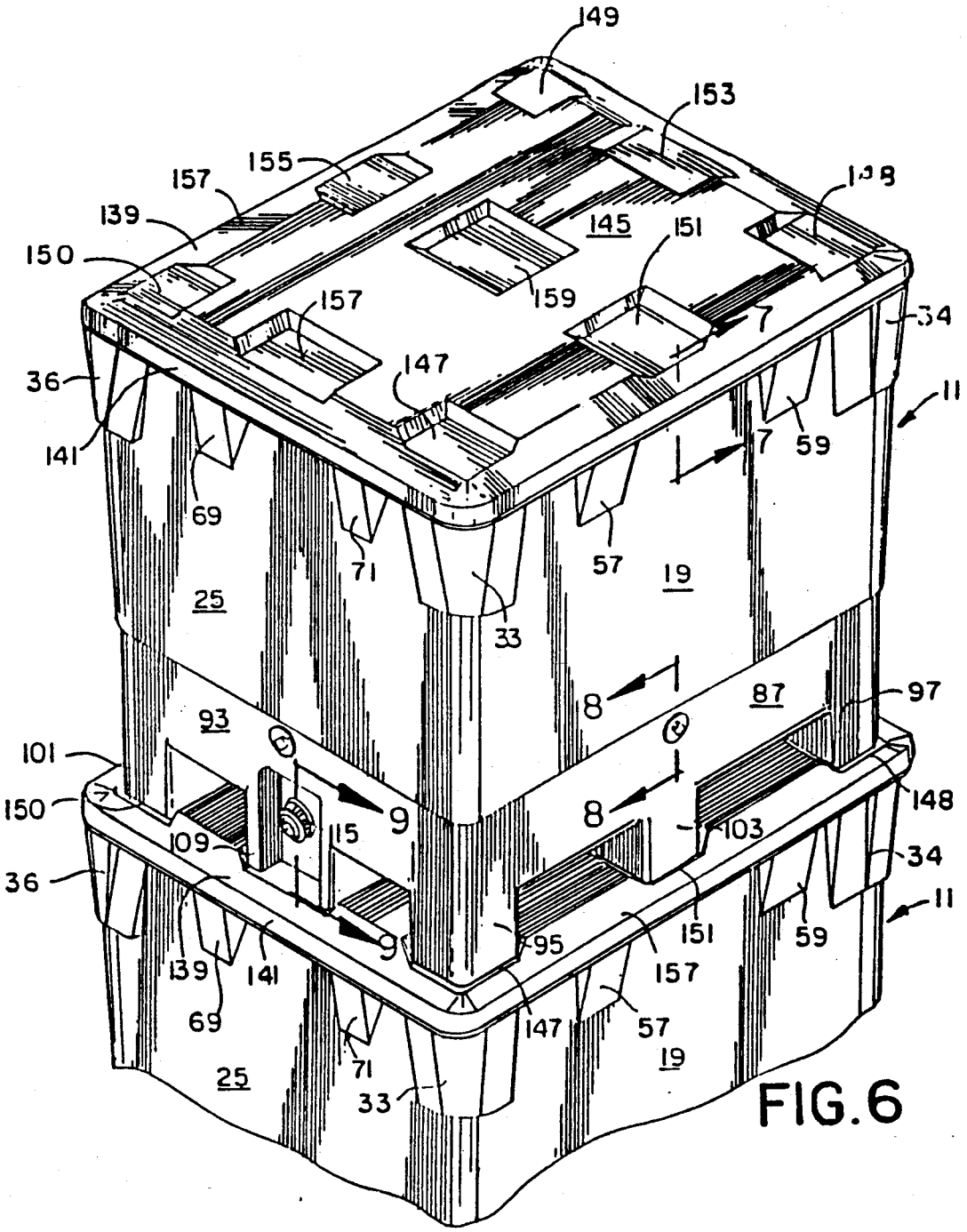
FIG. 6 is a perspective view of two filled containers stacked one on top of the other.
Figure 7:
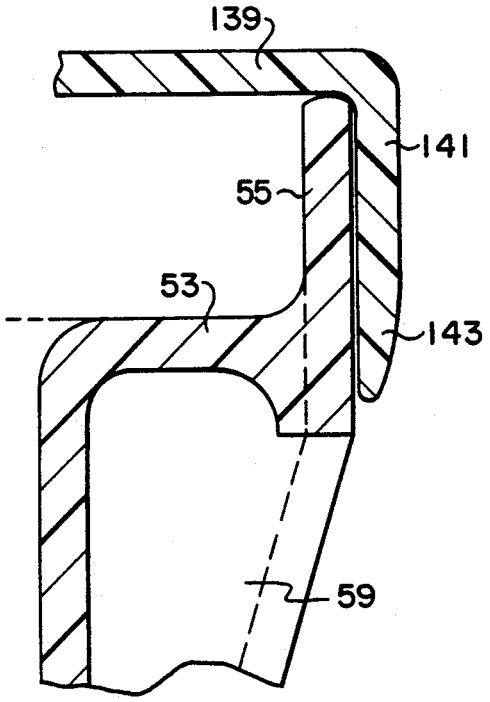
FIG. 7 is a partial view in section of the container showing the lip of the tank and a lid closing the tank taken as indicated by the lines and arrows 7—7 in FIG. 6.
Figure 9:
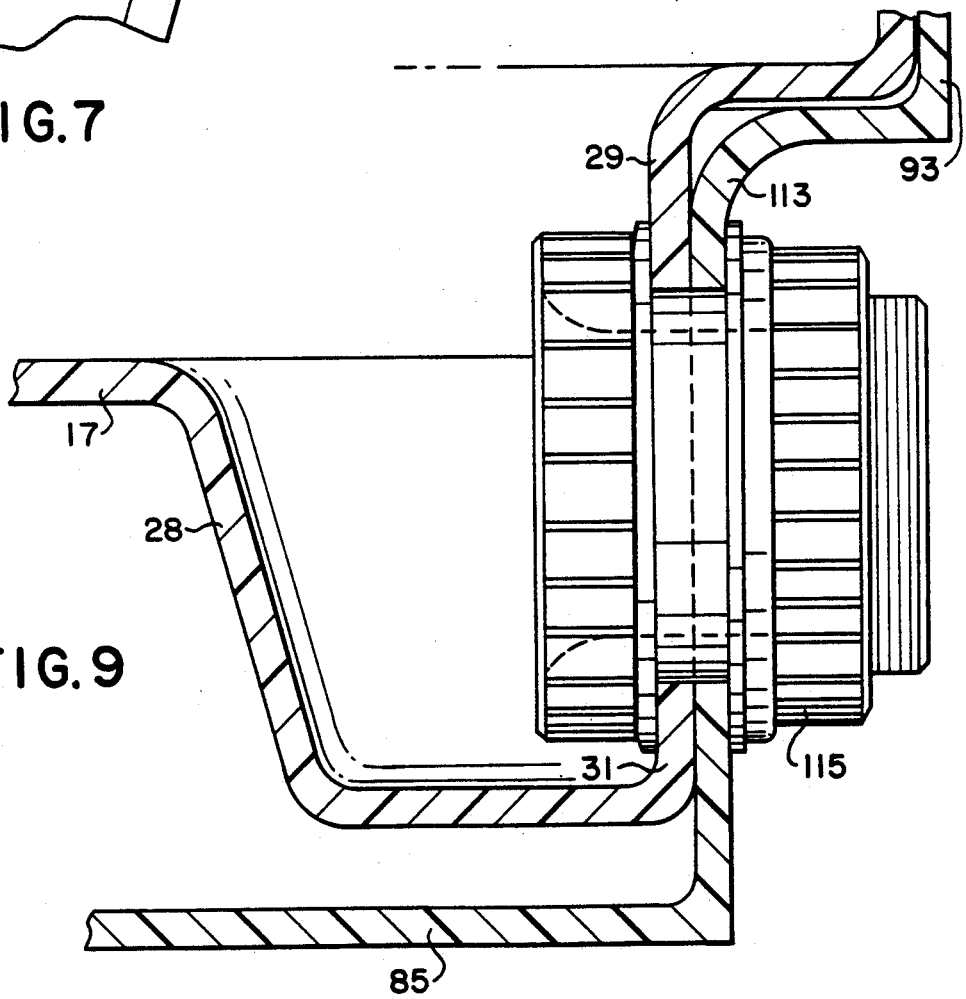
FIG. 9 is a partial view in section taken as indicated by the lines and arrows 9—9 of FIG. 6.

As is shown in FIGS. 6 and 9, container 11 may be provided with a drain fitting 115 in sump 28 to enable the container 11 to be coupled with any external plumbing that may be required in various applications.

ADVANTAGES

Among the advantages of the new container is that only the pallet base needs to be in contact with and exposed to damage caused by the tines of a forklift truck or a pallet jack. Therefore, if the tines cause damage to a pallet base 15 of container 11, only pallet base 15, rather than the entire container 11, needs to be replaced.

Container 11 is of such width that it fits side-by-side on common carrier trailer trucks, and is provided with a reinforced lip 27 which resists breakage.

Another advantage of container 11 is that various drain fittings 115 may be added to it so that the container may be coupled with an external plumbing that may be required.

I claim:

1. A plastic container for transporting and storing large quantities of bulk materials comprising a molded plastic tank having a substantially flat bottom wall without legs that is easily cleaned and four sidewalls extending upwardly from the bottom wall, said tank having an open top, base means comprising a molded plastic pallet base for supporting the tank and for providing spaces for entry of the tines of a forklift truck or a pallet jack, connecting-disconnecting means for connecting the pallet base the tank and for detaching the pallet base from the tank when desired, as when the pallet base becomes damaged, the pallet base being replaceably secured to the tank by the connecting-disconnecting means, the pallet base being a molded, tub-like, plastic pallet base with a bottom wall and four sidewalls extending upwardly from the pallet base, the top portion of said pallet base sidewalls overlapping the bottom portion of the tank sidewalls to provide a strong overlapping connection between the tank and the pallet base, the pallet base bottom wall including downwardly extending pallet legs, and with the flat bottom wall of the tank being positioned above the pallet legs so that a forklift prong that penetrates the legs does not penetrate the tank, and spaces formed between adjacent pallet legs providing for the entry of the tines of a forklift truck or of a pallet jack, whereby only the pallet base, rather than the entire container, need be replaced if the tines of a forklift truck or a pallet jack damage the pallet base.

2. The container of claim 1, further including drainage means for draining the tank.

3. The container of claim 2, said drainage means including a sump molded into the tank bottom wall leading to a drain fitting that extends through a tank side wall and a corresponding pallet base side wall.

4. The container of claim 1, further including a lid having a skirt that fits over the lip of the tank.

5. The plastic container of claim 1, including the tank sidewalls having an upper portion and a lower portion with the upper portion positioned outwardly of the lower portion, a horizontal sidewall ledge connected between the sidewall upper portion and the sidewall lower portion, a downwardly extending ridge molded into the tank and extending downwardly from the outer portion of the sidewall ledge and extending around the perimeter of the tank and forming a perimeter groove around the tank, the lower portion of the tank sidewalls being seated inside the pallet base sidewalls which overlap the tank sidewalls to provide a strong double wall connection between the tank and pallet base, the inner surface of the pallet base sidewalls contacting the outer surface of the tank sidewalls, the top of the pallet base sidewalls being seated in said perimeter groove to form a three-ply connection between the tank and pallet base including the lower sidewalls of the tank, the sidewalls of the pallet base and said downwardly extending ridge.

6. The plastic container of claim 1, including a lip extending along the upper edge of the four sidewalls of the tank, the lip including a horizontal lip ledge at the top of the tank sidewalls and a vertical lip wall extending upwardly from the outer portion of the lip ledge, sidewall combined lip support and camming means extending from the tank sidewalls for supporting the lip at the top of the four tank sidewalls and for camming an upper container being lowered next to a lower container into proper position next to the lower container if the sidewall lip support and camming means of the upper container while being lowered strikes an overhanging portion of the lid or lip of the lower container, the sidewall lip support and camming means being sidewall camming gussets extending from the tank sidewalls to the outer portion of the lip and flaring outwardly from bottom to top where the sidewall gussets merge with the vertical lip wall and are flush with the outer surface of the vertical lip wall, the corner lip support and camming means extending from the tank corners for supporting the lip at the corners of the tank, for camming an upper container being lowered next to a lower container into proper position next to the lower container if the corner lip support and camming means of the upper container while being lowered strikes an overhanging portion of the lid or lip of the lower container, and for acting as bumpers to protect the tank corners from damage from impact, the corner lip support and camming means being corner camming gussets extending from the tank at the tank corners and flaring outwardly from bottom to top where the corner gussets merge with the vertical lip wall and are flush with the outer surface of the vertical lip wall.

7. The plastic container of claim 1, the pallet base including a molded, tub like, plastic pallet base having a bottom wall and four sidewalls extending upwardly from the bottom wall, the pallet base bottom wall including a downwardly extending hollow leg in each corner of the pallet base bottom wall, a downwardly extending hollow leg halfway between each corner leg, and a downwardly extending hollow leg in the center of the pallet base bottom wall, spaces formed between adjacent legs for entry of tines of a forklift truck or a pallet jack, whereby the container may be transported by a forklift truck or a pallet jack without the use of a separate pallet, and whereby the container is accessible to the tines of a forklift truck or a pallet jack from all four sides of the container.

8. The container of claim 1, further including a lip along the upper edges of the four upwardly extending side walls of the tank, the tank side walls including nesting stop means for facilitating nesting and unnesting of the container in a similar container by limiting the distance an upper nesting container extends into a lower nesting container, the tank side walls further including lip support means extending from the tank side walls for supporting the lip at the top of the four tank side walls and for guiding a container being lowered next to an adjacent container into proper position next to the adjacent container if the container being lowered strikes an overhanging portion of the lid or lip of the adjacent container.

9. The container of claim 8, the lip including a lip ledge at the top of the tank side walls and a lip wall extending upwardly from the outer portion of the lip ledge.

10. The container of claim 8, the nesting means being nesting stops located in each corner of the upper end of the tank.

11. The container of claim 8, including corner gusset means for guiding a container into position adjacent another container, for supporting the lip, and for acting as bumpers to protect the tank corners from danger.

12. A molded plastic container for transporting and storing large quantities of bulk materials comprising a molded plastic tank having a substantially flat bottom wall without legs that is easily cleaned and four sidewalls extending upwardly from the bottom wall, said tank having an open top, pallet means for supporting the tank from below including pallet legs with spaces between the pallet legs for admitting the tines of a forklkft truck or pallet jack, and connecting-disconnecting means for connecting the pallet legs to the bottom of the tank and for disconnecting the pallet legs from the tank as when it is desired to replace a broken pallet leg, whereby only the pallet legs, rather than the entire container, need be replaced if only the pallet legs are damaged as by the tines of a forklift truck.

13. A plastic container for transporting and storing large quantities of bulk materials comprising a molded plastic tank having a substantially flat bottom wall that is easily cleaned and four sidewalls extending upwardly from the bottom wall, said tank having an open top, base means comprising a molded plastic pallet base for supporting the tank and for providing spaces for entry of the tines of a forklift truck or a pallet jack, and connecting-disconnecting means for connecting the pallet base to the tank and for detaching the pallet base from the tank when desired as when the pallet base becomes damaged, the pallet base being replaceably secured to the tank by the connecting-disconnecting means, the pallet base being a molded, tub-like, plastic pallet base with a bottom wall, and four sidewalls extending upwardly from the pallet base.

14. The plastic container of claim 13, said connecting-disconnecting means comprising a number of nut and bolt elements in combination, one of said elements of each nut and bolt combination being molded into the tank, and the other of said elements of each nut and bolt combination connecting to said one of said elements, and connecting the pallet base to the tank.

15. A plastic container for handling and storing large quantities of bulk material such as food products, comprising a molded plastic tank having a bottom wall and four upwardly extending side walls, pallet base means replaceably mounted to the tank for supporting the tank and for providing spaces for entry of tines of a forklift truck or a pallet jack, the pallet base means including a molded, tub-like, plastic pallet base having a bottom wall and four upwardly extending side walls, the pallet base bottom wall including a downwardly extending hollow leg in each corner of the pallet base bottom wall, a downwardly extending hollow leg halfway between each corner leg, and a downwardly extending hollow leg in the center of the pallet base bottom wall, whereby the pallet base means is replaceably secured to the tank, and whereby only the pallet base means of the container, rather than the entire container, need be replaced if the tines of a forklift truck or a pallet jack damage the pallet base means of the container, the tank bottom wall being flat, a lip along the upper edges of the four upwardly extending side walls of the tank, the tank side walls including nesting stop means for facilitating nesting and unnesting of the container to a similar container by limiting the distance an upper nesting container extends into a lower nesting container, the tank side walls further including lip support means extending from the tank side walls for supporting the lip at the top of the four tank side walls and for guiding a container being lowered next to an adjacent container into proper position next to the adjacent container if the container being lowered strikes an overhanging portion of the lid or lip of an adjacent container, the lip including a lip ledge at the top of the tank side walls and a lip wall extending upwardly from the outer portion of the lip ledge, the lip support means for supporting the lip being gussets extending from the tank side walls to the outer portion of the lip, the nesting means being nesting stops located in each corner of the upper end of the tank, and corner gusset means for guiding a container into position adjacent another container, for supporting the lip, and for acting as bumpers to protect the tank corners from danger.

16. The container of claim 15, further including drainage means for draining the tank, the drainage means including a sump molded into the tank bottom wall leading to a drain fitting that extends through a tank side wall and a corresponding pallet base side wall.

17. The container of claim 15, further including a lid having a skirt that fits over the lip of the tank.

18. A plastic container for handling and storing large quantities of bulk material such as food products, comprising a molded plastic tank having a bottom wall and four upwardly extending side walls having a lip, pallet base means replaceably mounted on the tank for supporting the tank and for providing spaces for entry of tines of a forklift truck or a pallet jack, the tank side walls including nesting stop means for facilitating nesting and unnesting of the container to a similar container by limiting the distance an upper nesting container extends into a lower nesting container, the nesting means being nesting stops located in each corner of the upper end of the tank, and corner gusset means for guiding a container into position adjacent another container, for supporting the lip, and for acting as bumpers to protect the tank corners from danger.

19. The container of claim 18, further including drainage means for draining the tank.

20. The container of claim 18, further including a lip along the upper edges of the four upwardly extending side walls of the tank, and a lid having a skirt that fits over the lip of the tank.

21. A plastic container for handling and storing large quantities of bulk material such as food products, comprising a molded plastic tank having a bottom wall and four upwardly extending side walls, pallet base means for supporting the tank and for providing spaces for entry of the tines of a forklift truck or a pallet jack, and mounting means for replaceably mounting the pallet base means on the tank, whereby the pallet base means is replaceably secured to the tank, and whereby only the pallet base means of the container, rather than the entire container, need be replaced if the tines of a forklift truck or a pallet jack damage the pallet base means of the truck, the pallet base means including, a molded, tub-like, plastic pallet base having a bottom wall and four upwardly extending side walls, the pallet base bottom wall including a downwardly extending hollow leg in each corner of the pallet base bottom wall, a downwardly extending hollow leg halfway between each corner leg, and a downwardly extending hollow leg in the center of the pallet base bottom wall, and spaces formed between adjacent legs for entry of tines of a forklift truck or a pallet jack, whereby the container may be transported by a forklift truck or a pallet jack without the use of separate pallet, and whereby the container is accessible to the tines of a forklift or a pallet jack from all four sides of the container the mounting means including bolt means mounted into each side wall of the tank and extending outwardly and through a corresponding pallet base side wall, nut means attached to the outer end of each bolt means for securing the tank side walls to the corresponding pallet base side walls, bolt means molded into the tank bottom wall and extending downwardly through the pallet base bottom wall, and nut means attached to the bolt means for securing the pallet base bottom wall to the tank bottom wall.

* * * * *